United States Patent [19]

Shilkov et al.

[11] Patent Number: 4,607,980

[45] Date of Patent: Aug. 26, 1986

[54] APPARATUS FOR COMPACTING SOIL, CONCRETE AND LIKE MATERIALS

[75] Inventors: Vladimir A. Shilkov; Andrei V. Shilkov; Petr D. Kuzmin, all of Leningrad; Vladimir S. Metrikin, Gorky; Vladimir A. Chumichev; Anatoly I. Borovtsev, both of Moscow; Nikolai I. Dubenkov, Vladimir, all of U.S.S.R.

[73] Assignee: Spetsialnoe Konstruktorskoe Bjuro "Stroimekhanizatsia", Osipenko, U.S.S.R.

[21] Appl. No.: 678,991

[22] Filed: Dec. 6, 1984

[51] Int. Cl.[4] ..... E01C 19/34

[52] U.S. Cl. ..... 404/133; 175/95; 175/122

[58] Field of Search ..... 404/133; 173/122, 95

[56] References Cited

U.S. PATENT DOCUMENTS

| | | | |
|---|---|---|---|
| 2,772,858 | 12/1956 | Galvez | 173/122 X |
| 3,756,735 | 9/1973 | Linz | 404/133 |
| 3,802,791 | 4/1974 | Uebel et al. | 404/133 |
| 3,834,827 | 9/1974 | Linz | 404/133 |
| 4,015,909 | 4/1977 | Yamamoto | 404/133 |
| 4,095,654 | 6/1978 | Ross | 173/122 X |

FOREIGN PATENT DOCUMENTS

| | | | |
|---|---|---|---|
| 483501 | 4/1938 | United Kingdom | 404/133 |
| 323508 | 11/1972 | U.S.S.R. . | |
| 726250 | 4/1980 | U.S.S.R. . | |

*Primary Examiner*—Stephen J. Novosad
*Assistant Examiner*—John F. Letchford
*Attorney, Agent, or Firm*—Fleit, Jacobson, Cohn & Price

[57] ABSTRACT

An apparatus for compacting soil includes a tamping shoe with anvils, a reaction mass with an anvil and an impact mechanism comprising a crank gear installed in a casing and having hammer rams which are oppositely directed and which are coaxial with the anvils of the tamping shoe and reaction mass.

3 Claims, 4 Drawing Figures

APPARATUS FOR COMPACTING SOIL, CONCRETE AND LIKE MATERIALS

FIELD OF THE ART

Figure 4:
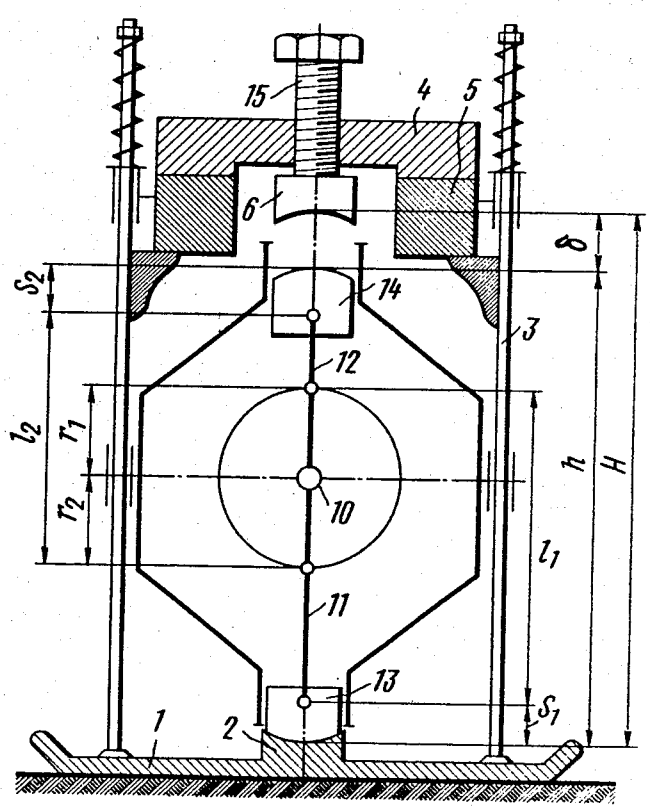

The invention relates to construction and road-building machines, and more particularly, it deals with apparatus for compacting soil, concrete and like materials.

The invention may also be successfully used for driving into soil various structural members and as a vibration generator in arrangements for forming concrete and reinforced concrete products.

Known in the art is a vibratory tamper comprising a casing with hammers, a tamping shoe with anvils and a casing drive with a cam mechanism installed on the shoe (cf. USSR Inventor's Certificate No. 726250, publ. Apr. 5, 1980).

The arrangement of the cam mechanism with the drive motor on the shoe of this vibratory tamper results in an increase in the mass of the shoe, hence in excessive energy losses upon collisions of interacting masses, i.e. in a low efficiency of compaction. The low efficiency of compaction is also caused by the fact that the total mass of the casing and hammers is low so that a mechanism of an increased power output is required for driving the casing in order to ensure an adequate impact energy. This, as mentioned above, results in an increased mass of the shoe and affects the efficiency of compaction. In addition, the low efficiency of compaction is caused by a low blow rate and a narrow range of stable operation since the time of the free travel of the impact part between successive blows is long and this time increases with an increase in the resistance of the medium being compacted to the impact action because this causes an increase in the recoil of the impact part.

There is another apparatus for compacting soil, concrete and like materials.

The apparatus comprises a tamping shoe with anvils, columns of the tamping shoe supporting an impact mechanism having a drive in the form of a crank gear having cranks which are equal in size and shifted in phase, and connecting rods connected to hammer rams, one hammer ram being made with a through hole and functioning as a guide for the other hammer ram. Both hammers face toward the shoe and have a common anvil (cf. USSR inventor's Certificate No. 323508, publ. Dec. 10, 1971).

While this apparatus features a lower metal consumption for its manufacture and is more efficient in compacting owing to an increased amount of energy transmitted by the impact part to the soil due to an increased velocity and longer time of load application during the successive actions of the impact mass through the hammer rams, it also has a number of disadvantages.

Thus, the more intense the hammering performed by the working member based on this principle during each impact cycle, the lower are frequencies at which it can work steadily since an increase in the intensity of loading of the soil results in an increased recoil of the impact mechanism because it is not provided with means for limiting the amount of recoil, hence the working cycle time increases.

Another limitation is a narrow range of control of the intensity and time of the force application to the material being compacted, and control of operating conditions which are desirable from the point of view of the compaction process, especially in performing production operations, is also rather limited.

It is the main object of the invention to improve the efficiency of soil compaction.

Another object of the invention is to provide for a stable operation within a large range of load application.

Still another object of the invention is to reduce metal requirements for the construction of the apparatus.

These and other objects are accomplished by that in an apparatus for compacting soil, comprising a tamping shoe with anvils, columns mounted on the shoe and supporting an impact mechanism comprising a crank gear installed in a casing and having hammer rams, and a reaction mass with hammers, according to the invention, the reactive mass is provided with a vertically movable anvil and the hammer rams are oppositely directed and are installed in the aligned position with the shoe anvils and with the reaction mass anvil.

It is known that if the frequency of load application is high enough and the time interval between successive actions is shorter than the recovery time of strains caused by each individual loading, irreversible settlements are accumulated.

This results in the expediency of trying to improve the efficiency of compaction by increasing the load application frequency. One of the ways of reducing the cycle time by reducing the time necessary for the rise and fall of the impact mass in cooperation with a limiting means resides in limiting the height of rise of the impact part of the working member concurrently with a positive acceleration of the impact part when it moves toward a working member (tamping shoe).

A method of acting on media using vibration and impact parameters varying in time is the most universal and efficient. Its advantage as compared to any known modern methods of compaction of material resides in the possibility of fully taking into account physico-mechanical properties of a medium and the action of the system as a whole and of individual components as well as in the possibility of controlling the working process under operating conditions.

Therefore, the structural system of the working member of impact and vibratory action, in which the height of rise and fall of the impact mass is limited, not only permits providing stable operating conditions over a wide range of vibration generator shaft speeds, but also enables the acting on work media with parameters of vibration and impact varying in time by using a simple control means.

An additional advantage of working members of such type as compared to the prior art resides in the fact that they feature a higher efficiency of action on media within each cycle owing to the possibility of substantially increasing the energy spent on useful work by prolonging time and increasing intensity of loading.

Figure 1:
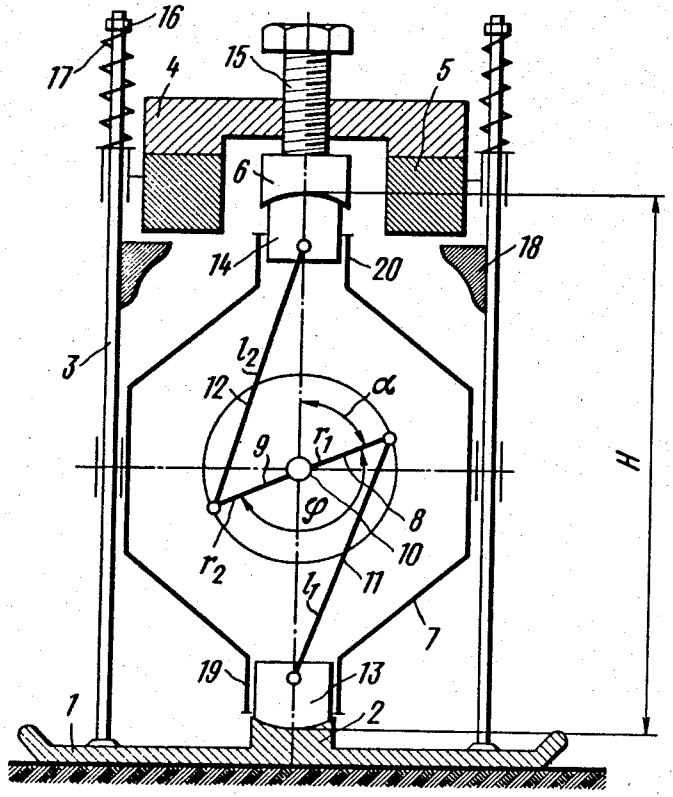
Figure 3:
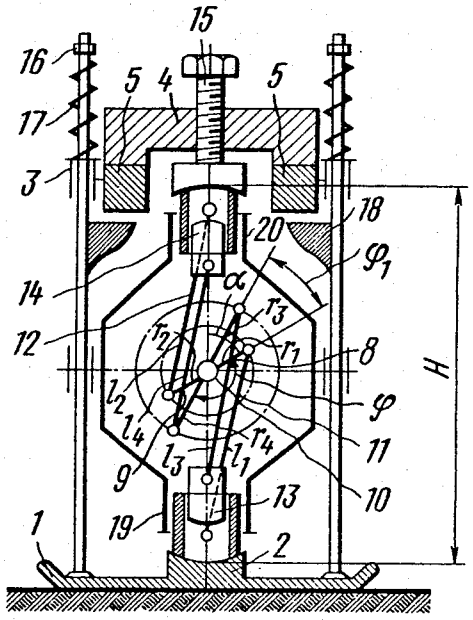
Figure 2:
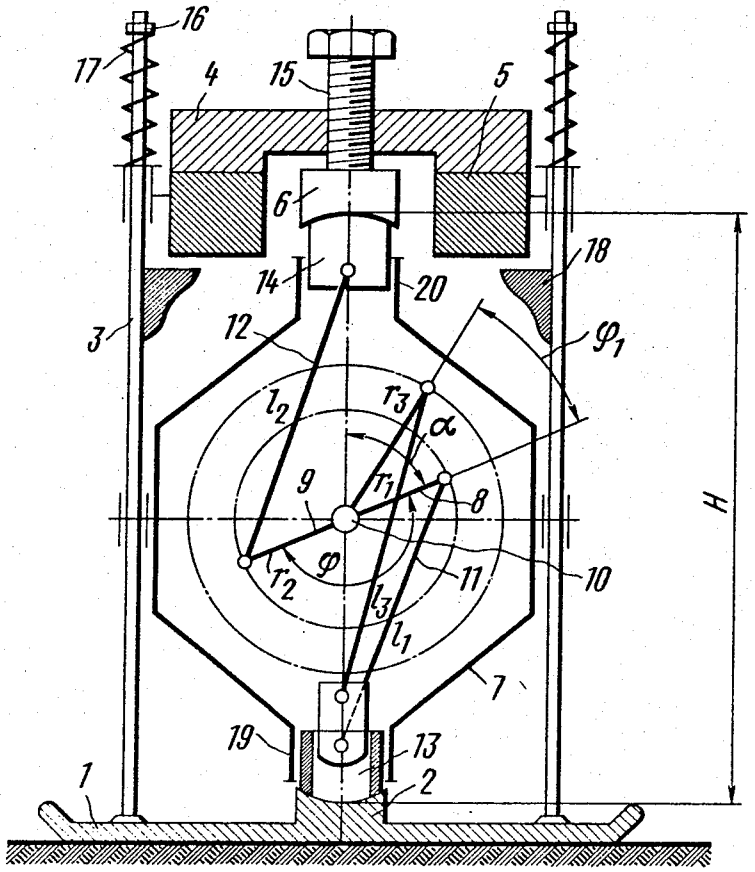

The invention will now be described as applied to its specific embodiments with reference to the accompanying drawings, in which:

FIG. 1 schematically shows a longitudinal section view of an apparatus for compacting soil according to the invention;

FIG. 2 is another embodiment of an apparatus according to the invention;

FIG. 3 still another embodiment of an apparatus according to the invention;

FIG. 4 is ditto of FIG. 4, shown in the initial position.

An apparatus for compacting soil comprises a tamping shoe 1 (FIG. 1) having an anvil 2 and vertical columns 3, a reaction mass 4 having hammers 5 and an auxiliary anvil 6, and an impact mechanism comprising a crank gear installed in a casing 7 and supported by the columns 3.

The crank gear has cranks 8 and 9 mounted on a shaft 10 and connecting rods 11 and 12 having hammer rams 13 and 14 secured to their free ends and cooperating with the anvils 2 and 6.

The hammer rams 13 and 14 are oppositely directed and are installed in the aligned position with the anvils 2 and 6.

The anvil 6 of the reaction mass 4 is vertically movable with respect to the hammer 5 so as to provide for adjustment of the distance "H" between the anvils 2 and 6. This adjustment can be achieved by any appropriate known means, e.g. by means of an adjusting bolt 15.

Nuts 16 are threaded on the ends of the columns 3, and elastic members such as springs 17 are placed between the nuts and the reaction mass 4.

The hammers 5 of the reaction mass 4 cooperate with the shoe 1 through anvils 18, and the hammer rams 13 and 14 move along guides 19 and 20 which are coaxial with the vertical center line.

The cranks 8 and 9 are eccentrically installed on the shaft 10 and are phase shifted at an angle $\phi$, the crank 8 having a radius $r_1$ and the crank 9, a radius $r_2$, the radii $r_1$ and $r_2$ being equal or different. The connecting rods 11 and 12 have lengths $l_1$ and $l_2$, and the hammer rams 13 and 14 have heights $S_1$ and $S_2$, the distance between the impact surfaces of the rams being "h".

The number of the hammer rams 13 and 14 cooperating with the anvils 2 and 6 may be two or more, as shown in FIGS. 2 and 3. The additional cranks and connecting rods may have radii $r_3$ and $r_4$ and lengths $l_3$ and $l_4$, respectively.

The apparatus functions in the following manner.

Torque is transmitted from the motor to the crankshaft 10, and the hammer rams 13 and 14 reciprocate in the opposite directions in the guides 19 and 20 relative to the casing 7 so as to regularly interact with the anvils 2 and 6. As a result the casing 7, the tamping shoe 1 and the reaction mass 4 start reciprocating relative to one another.

Operating conditions mainly depend on the crankshaft speed, eccentricities of both cranks 8 and 9 and ratio therebetween, on ratios between movable masses, force of elastic members, value of H—minimum possible distance between the anvils 2 and 6 (during the engagement of the hammers 5 with the anvils 18) and on the total distance between the impact surfaces of the hammer rams 13 and 14 when they are at the lower dead center with respect to the casing 7, which is equal to $h=l_1+S_1+S_2+l_2-r_2-r_1$, as shown in FIG. 4.

By varying the value of H by acting upon the adjusting means 15, the following operating conditions may be provided. With $H=h=l_1+S_1+l_2+S_2-r_2-r_1$, i.e. when the value of H is to be chosen almost equal to the distance h between the impact surfaces of the hammer rams 13 and 14 when they are at the lower dead center, the compacting action is obtained owing to the repulsion impulse between the reaction mass 4 and the tamping shoe 1 which acts at the moments when the hammer rams move away from each other (when they move away from the lower and upper dead centers, respectively) and owing to the impact action of the reaction mass on the tamping shoe at the moment of collision of the hammers 5 with the anvils 18 when the hammer rams approach the lower dead center.

Maximum amplitude of relative displacements (with a sufficient force of the elastic members 17 for the combined movement of the hammer 14 with the reaction mass 4 and tamping shoe 1) under the conditions defined by the above ratio between their parameters, is $A=2(r_1+r_2)$, and maximum values of velocities of relative movement (when the cranks are in the horizontal position, i.e. when the angular position of the crank is defined by the angle $\alpha=90°$ to the vertical along the rotation direction) are $$v=(r_1+r_2)\omega.$$

When the reaction mass and the tamping shoe move relative to each other in the opposite directions, the elastic members 17 are compressed. After the hammer rams 13 and 14 pass through the upper dead center, the reaction mass 4 moves down under the action of gravity and forces of the elastic members 17. The hammers 5 and the mass 4 will blow at the anvils 18 of the tamping shoe 18, hence at the soil, Immediately after this impact action, the hammer rams will start moving away from each other again thus imparting a repulsion action, and the process is repeated. Therefore, the time of the vibration and impact action in this case is equal to one half of the period of rotation of the crankshaft 10.

With $l_1+S_1+l_2+S_2-r_2-r_1<H<l_1+S_1+l_2+S_2+r_2+r_1$ (see FIG. 4) the casing 7 of the crank gear which is the vibration generator, when in the initial position, is the main impact mass of the vibratory tamper and is supported by the anvil 2 through the hammer ram 13. Both hammer rams 13 and 14 are at their lower dead centers, the upper (auxiliary) hammer ram 14 being disposed below the impact surface of the anvil 6 by the amount $$\delta=H-h=H-l_1-S_1-r_1-l_2-S_2-r_2.$$

Depending on the pre-set value of h and chosen dimensions of the crank gear, during rotation of the crankshaft 10, the upper hammer ram 14 cooperates with the anvil 6 which is installed on the reaction mass 4 during rotation of the crank 8 from the vertical position through an angle $0°<\alpha<180°$ such that the upper hammer ram 14 had travelled from its initial position through an amount equal to the pre-set spacing $\delta$.

Before the upper hammer engages the anvil, the tamping shoe is subjected to a dynamic action owing to the repulsion therefrom of the mass of the vibration generator (the mass of the main impact part enclosed in the casing 7) at the velocity equal to the velocity of the hammer ram 13.

At the moment when the upper hammer 14 engages the anvil 6, an impact action is transmitted through the crank gear to the tamping shoe, the amount of this action depending on the ratio of masses of the hammer ram 14 and reaction mass 4 and on the velocity of their collision.

Depending on the ratio of velocities of the relative movement of the reaction mass 4 and the tamping shoe 1 and velocity of the "parting" movement of the hammer rams 13 and 14, the subsequent movement of the components of the vibratory tamper may be similar to that described above if maximum amplitude of displacement is $A=2(r_1+r_2)-\delta$ (with the velocities of the reaction mass after the impact equal or lower than the velocity of the "parting" movement ) or with the separation of the reaction mass from the vibration generator with subsequent repeated collision (with the velocities of the reaction mass greater than the velocity of the "parting" movement of the hammer rams during the impact collision) when the anvil 6 of the reaction mass 4 and the upper piston 14 continuing to move upwards will engage each other again. Still another kind of impact action occurs when the hammers 5 of the reaction mass will impart blow at the anvil 18 of the tamping shoe.

With $H > l_1 + S_1 + l_2 + S_2 + r_2 + r_1$ the vibration generator is in the same initial condition as in the latter case. The difference in the operating conditions resides in the fact that collisions between the upper hammer ram 14 and the anvil 6 of the reaction mass 4 can only occur when the vibration generator jumps with respect to the tamping shoe 1 during the impact interaction between the hammer ram 13 with the anvil 2 of the tamping shoe 1.

Similarly to the abovedescribed cases, during the movement of the hammer ram 13 in the direction from the lower to the upper dead center (which is the case when the crank 8 moves within the range of its rotation angle $0° \leqq \alpha \leqq 180°$) the casing 7 of the vibration generator is pushed away from the tamping shoe 1.

It should be noted that, depending on the speed $\omega$ of the shaft 10, the following operating conditions may be obtained (the other conditions being the same).

Vibratory operation is obtained as a result of oscillations of the casing 7 of the crank gear relative to the tamping shoe with the peak-to-peak amplitude $A_1 = 2r_1$ at the same frequency $\omega$ at which the conditions for the separation of the hammer ram 13 from the anvil 2 are not fulfilled.

Statistical moments of unbalanced masses of the vibrator can in such case be defined with a sufficient degree of approximation as products of the mass of the whole vibrator generator minus masses of both hammer rams by the eccentricity of the crank 8 and the eccentricity of the respective crank 9.

In this case the reaction mass 4 functions are an inertial-less surcharge of the tamping shoe 1.

A single-blow impact and vibration operation at frequencies $\omega$ at which the hammer ram 13 separates from the anvil 2 is obtained as a result of oscillations of the casing 7 with the peak-to-peak amplitude $A_2 > 2r_1$, the jumps being rather insufficient for the upper hammer ram 14 to cooperate with the anvil 6.

The value of the impact impulse at the moment of engagement of the hammer ram 13 with the anvil 2 is determined by the value of the total velocity of the gravity fall of the casing 7 and the velocity of movement of the hammer 13 relative to the casing.

A two-blow impact and vibration operation can be obtained at such frequencies $\omega$ of the vibration generator shaft at which, as a result of the impact interaction of the vibration generator with the tamping shoe, the jumps of the casing 7 becomes sufficient for the upper hammer ram 14 to cooperate with the anvil 6. The working cycle will then consist of the following movements in the impact cooperation of the vibration generator with the tamping shoe: the flight of the casing 1 away from the tamping shoe 1 toward the reaction mass 4, the impact interaction between the vibration generator and the reaction mass when the impact surfaces of the upper hammer 14 and the anvil 6 engage each other so that the reaction mass 4 starts moving in the guides in the direction away from the tamping shoe 1 to deform the elastic members 17. The casing 7 of the vibration generator starts moving toward the tamping shoe at a velocity equal to the difference between the velocity of movement of the hammer ram 14 relative to the casing 7 and the velocity of movement of the reaction mass, then the free flight of the casing follows in the direction away from the reaction mass toward the tamping shoe after the separation of masses of the vibration generator and the reaction mass, and the subsequent impact interaction of the vibration generator with the tamping shoe through the hammer ram 13 and the anvil and the impact interaction of the reaction mass 4 with the tamping shoe 1 through the hammers 5 and anvils 18 as a result of this mass falling under gravity and forces of the elastic members from the height to which it has been raised upon the interaction with the vibration generator.

The compaction cycle time and blow frequency are chosen taking into account soil properties and desired compaction depth.

This design of the apparatus also makes it possible to enlarge its field of application owing to the simplicity of readjustment of operating conditions.

We claim:

1. An apparatus for compacting soil, concrete, and other materials, said apparatus comprising:

a tamping shoe;

columns secured on said tamping shoe;

a reaction mass mounted on said columns and provided with hammers;

a casing mounted on said columns;

cranks fitted on a drive shaft and shifted in phase by a predetermined angle within said casing;

connecting rods coupled with said cranks;

hammer rams provided within said casing and facing upward and downward in opposite directions and moving within said casing in opposite directions under the force of said connecting rods;

at least one first anvil adapted to take up the impacts of at least one downward moving hammer ram and mounted on said tamping shoe;

second anvils adapted to take up the impacts of the hammers of the reaction mass and mounted on said columns; and at least one third anvil adapted to take up the impacts of at least one upward moving hammer ram to move vertically and mounted on the reaction mass;

said hammer rams cooperating with said first anvil and said third anvil and being in a coaxial relationship with said first anvil and said third anvil.

2. An apparatus as claimed in claim 1, wherein the number of hammer rams, cranks and connecting rods, respectively, is at least three, and at least one of the hammer rams being directed upward and cooperating with said at least one third anvil, a second and at least a third one of said hammer rams being directed downward and cooperating with said at least one first anvil, at least a third one of said cranks being mounted on the shaft at a phase shift relative to said cranks in the direction of shaft rotation by an angle which is smaller than said predetermined angle.

3. An apparatus as claimed in claim 1, wherein said cranks of the hammer rams have different sizes.

* * * * *